US007175062B2

(12) United States Patent
Shah

(10) Patent No.: US 7,175,062 B2
(45) Date of Patent: Feb. 13, 2007

(54) HAND-HELD TAPE DISPENSER HAVING BRAKE AND FLEXIBLE SIDE

(75) Inventor: Kumud Shah, Nairobi (KE)

(73) Assignee: Kitaru Innovations Inc., St James (BB)

( * ) Notice: Subject to any disclaimer, the term of this patent is extended or adjusted under 35 U.S.C. 154(b) by 0 days.

(21) Appl. No.: 09/883,306

(22) Filed: Jun. 19, 2001

(65) Prior Publication Data

US 2002/0190091 A1 Dec. 19, 2002

(51) Int. Cl.
*B26F 3/02* (2006.01)

(52) U.S. Cl. ..... 225/47; 225/51; 225/77

(58) Field of Classification Search ..... 225/47, 225/51, 46, 58, 65, 66; 156/577; 242/588.3
See application file for complete search history.

(56) References Cited

U.S. PATENT DOCUMENTS 2,640,656 A * 6/1953 Donkin ..... 225/77
4,238,272 A 12/1980 Scheicher
4,244,503 A * 1/1981 Kramer ..... 225/46
4,729,578 A 3/1988 Mathna et al.
5,065,925 A * 11/1991 Ridenour ..... 225/47
5,171,397 A 12/1992 Arnold
5,759,342 A 6/1998 Luhman et al.

* cited by examiner

*Primary Examiner*—Hwei-Siu Payer
(74) *Attorney, Agent, or Firm*—Sand & Sebolt

(57) ABSTRACT

A tape dispenser dispenses rolled adhesive tape spirally wound on a hub. The dispenser has first and second side members, and a cutter member. Each of the side members has a first major side portion which overlies a roll of adhesive tape within the tape dispenser. A cylindrical axle portion is formed centrally on the inside surface of the first major side portion of each of the side members, and the cylindrical axle portions are telescopically received one in the other. At least the first side member is flexible in the region of the first major side portion, so that when it is flexed towards the second side member, the telescopic axle becomes shorter, and an interference of the hub and/or the tape with the side members occurs. Thus, a braking effect is imparted to the roll of adhesive tape, so as to preclude unwanted unreeling of the spirally wound adhesive tape from the hub.

10 Claims, 3 Drawing Sheets

HAND-HELD TAPE DISPENSER HAVING BRAKE AND FLEXIBLE SIDE

FIELD OF THE INVENTION

This invention relates to hand-held tape dispensers, and particularly to hand-held tape dispensers for adhesive tape of the sort which is used for ordinary household and office purposes. The invention particularly is directed to tape dispensers for dispensing household tape, where the dispenser has a selectively operable brake mechanism to preclude unwanted dispensing or unreeling of the tape, especially when it is being cut.

BACKGROUND OF THE INVENTION

Two kinds of tape dispenser are generally known, for two different kinds of tape. One kind of tape is wide tape—typically 6 to 10 cm wide, of the sort which is typically used to seal boxes and cartons, and the like. Many applications of such tape are from automatic machines; however, there are also many hand-held dispensers of the sort which are particularly used in warehouses and stores, for purposes of assembling and/or sealing boxes.

The other kind of adhesive tape which is in very wide usage, and for which the present invention is particularly intended, is that which is used for household or office purposes. Typically, such tape ranges from 1 to 2 cm in width, and may have varying degrees of tackiness depending on whether the tape is intended for permanent use or temporary use. Some such tapes may have a high gloss, others may have a low gloss such that they may be written on and are essentially invisible to imaging equipment such as photocopiers and facsimile machines.

For purposes of the present invention, such adhesive tape is referred to herein as "household tape". Household tape is generally sold and available in two formats: in rolls that are typically sold in boxes, for the purpose of being placed in a dispenser; and already installed in a dispenser. Dispensers, particularly of the hand-held variety, are generally formed of a moulded plastics material, and may or may not be capable of being disassembled for purposes of installing a new roll of adhesive tape therein. It is that kind of hand-held dispenser which is particularly the subject matter of the present invention.

Even such dispensers as are described immediately above may have metal cutters, although generally they are formed with an integral plastic cutter. Metal cutters are more likely to be found, however, on desktop dispensers which are generally very heavy, and into which a roll of household adhesive tape is placed to be dispensed therefrom. Also, metal cutters may be found on older tape dispensers from before 1990 or so.

Of course, any tape dispenser which has a metal cutter generally is such that it has a superior ability to cut tape due to the cutter's sharper and thinner construction; but such tape dispensers are more expensive to manufacture. Even if it were possible to provide plastic cutters which have significant sharpness, they become dull in use, and present somewhat of a danger-especially to the fingers of young children who might well be using household adhesive tape in their play, or for a school project or the like.

Plastic cutters may also accumulate shreds of adhesive tape or particles of adhesive, over time, and become somewhat clogged as a result. On the other hand, it has been discovered that if a plastic cutter—especially one which is molded integrally with the structure of the tape dispenser—is wider than the adhesive tape by at least about 25%, then after the adhesive tape has been unreeled it is possible to achieve a satisfactory cutting effect.

Of even greater concern in most instances is the fact that hand-held adhesive tape dispensers tend to overrun when the tape is being dispensed by pulling on the outer end thereof and unreeling the tape from the roll mounted on a hub within the tape dispenser. Still further, because of the somewhat loose condition of the free end of the tape between where it has left the roll and the cutter, and due particularly as well to the general dullness of plastic cutters, obtaining a clean cut of a particular desired length of tape may be difficult. Quite often, considerable manual dexterity is required, with some experimentation as to aligning the length of the tape which is to be cut from the roll at a particular angle either diagonally or vertically with respect to the cutter.

It has been observed that such difficulties, particularly when the adhesive tape is to be cut, can be overcome by applying some kind of braking action to the unreeled portion of adhesive tape—generally by pressing down with a finger on the tape just behind the cutting edge of the cutter on the dispenser. Even that arrangement is unsatisfactory, requiring considerable manual dexterity, and patience. On the other hand, a braking action applied to the roll of tape, and particularly to the hub on which the adhesive tape has been spirally wound, will achieve the desired braking effect on the tape as it is being cut, thereby permitting an easier cut. Still further, applying minimal braking action on the hub, while at the same time unreeling adhesive tape from the hub, can result in a very specific length of tape being unreeled and cut, if necessary.

Another manner of applying a braking action is to have a brake element which may selectively be applied against the circumference of the roll of tape. However, because the diameter of the roll of tape decreases as tape is unreeled therefrom, a considerable amount of travel is required for the braking element, especially when the last portions of the adhesive tape are being unreeled from the roll and off the hub on which they have been spirally wound.

It is possible to provide an adhesive tape dispenser for household adhesive tapes where one or both sides of the dispenser has certain flexibility, whereby a braking action can be applied against one or both sides of a roll of tape, or against one or both ends of the hub on which the tape has been spirally wound. Moreover, as a roll of tape is unreeled its diameter becomes smaller, and therefore the side surface of the roll of tape becomes smaller and a braking action against the side of the roll of tape may become less effective. Still further, depending on the conditions in which the tape has been made, spirally wound on the hub, and stored, it is possible that a deposit of adhesive might develop on the inside surface of the side of the tape dispenser if the side has been intermittently pressed against the side surface of the roll of tape, and that condition might cause considerable difficulty in smoothly unreeling adhesive tape away from the roll.

A co-pending application, Ser. No. 09/741,854, filed Dec. 22, 2000, teaches a tape dispenser which has at least one brake spoke extending from the inside surface of a side member, and radially extending and spaced away from a cylindrical axle of the tape dispenser. At least the first side member of that dispenser is flexible in the region of the first major side portion thereof, so that when the side member is flexed towards the second side member, the brake spoke extends into the annular void on the side of the cylindrical hub on which adhesive tape has been spirally wound. This causes frictional engagement between the brake spoke and at least one of the inner and outer cylindrical walls of the hub, and thereby imparts a braking effect to the hub so as to preclude unreeling of the spirally wound adhesive tape from the hub.

The present invention provides a further approach to the problem of applying a braking action to a roll of adhesive tape as it is being unwound from a tape dispenser. The present invention recognizes that interference between the hub on which the adhesive tape is spirally wound, and at least portions of the inside surfaces of the side members from which the tape dispenser is assembled, and or interference of the adhesive tape per se with the inside surfaces of the side members from which the tape dispenser is assembled, provides an effective braking action against the roll of adhesive tape. This braking action is effected by the provision of a flexible side on at least one of the side members, where the material itself of that side member is flexible so as not to require complicated and expensive moulding procedures to effect flexibility of a side member. Rather, at least a major portion of at least one side member is flexible, and the cylindrical axle on which the hub of the roll of adhesive tape is placed, is telescopically joined so that its length will change when the sides of the tape dispenser are pressed, thereby permitting interference between the sides of the tape hub together with the adhesive tape spirally wound thereon, with the inner surfaces of the first major side portions of the first and second side members from which the tape dispenser is assembled.

Accordingly, an inexpensive but effective tape dispenser is provided, whereby a braking effect against the roll of adhesive tape installed in the tape dispenser can be effected simply by squeezing the sides of the hand-held dispenser towards each other, or at least by squeezing one flexible side towards the other side.

DESCRIPTION OF THE PRIOR ART

Several representative examples of tape dispensers, both for industrial and commercial tape which tends to be fairly wide, as noted above, and for narrower household tape, are noted below.

Schleicher U.S. Pat. No. 4,238,272 issued Dec. 9, 1980 teaches a tape dispenser of the sort which may apply either to wide or narrow adhesive tapes, but is particularly of the sort which has relevance to narrow or household adhesive tapes. The device includes a post which extends between panels which are tear-drop shaped and between which the spool of tape is mounted, with the post being mounted in a position which is intermediate the spool of tape and a slot at the end of the dispenser through which the tape is dispensed directly onto a surface. A spring member is attached to the post, with one end having a serrated cutting edge and anvil which are disposed in the slot opening, and the other end impinges resiliently on the supply roll to act as a brake when a cutting action is undertaken.

Mathna et al U.S. Pat. No. 4,729,518, issued Mar. 8, 1988, teaches a tape dispenser of the sort which is a hand-held dispenser typically used for household adhesive tapes, and has a housing with hub and a roll of tape which is journaled on the hub. A paper backcard is disposed around one end of the hub and has a plurality of generally triangular projecting portions which project between the hub and the core. Those projections provide a friction brake between the hub and the core which thereby restricts rotation of the hub to an extent that unwanted rotation of the hub and uncoiling of the tape when it is withdrawn from the dispenser will be precluded. A metal cutter is included.

A self cutting tape dispenser, of the sort which may particularly be useful in commercial and industrial applications, is taught in Arnold U.S. Pat. No. 5,171,397, issued Dec. 15, 1992. Here, the tape dispenser has a moveable cover and a keeper which slides into a circumferential housing so as to keep a roll of tape on an axle. A brake plate is provided, and is such that when tape is being dispensed the thumb is inserted into an opening so as to push the brake plate against the circumference of the roll of tape. In fact, the roll of tape is pushed against the housing back at a time when a tape-cutting blade at the outside wall of the dispenser is pushed against the tape and given a twist so as to cut the tape. The dispenser is intended for one hand operation, and is easily refillable.

Another patent which particularly is directed to a hand-held dispenser used for dispensing industrial or commercial adhesive tape is Luhman et al U.S. Pat. No. 5,754,342, which provides a brake assembly that has a curved brake actuator and a flat brake plate. The structure acts to inhibit free rotation of the tape roll, and therefore the further dispensing of adhesive tape from the roll, when the operator applies pressure by squeezing with the thumb against the brake actuator so as to bend the brake plate about the tape roll and to increase pressure against the tape roll so as to facilitate tape cutting or tape stretching.

SUMMARY OF THE INVENTION

The present invention provides a tape dispenser for dispensing rolled adhesive tape which is mounted on a hub, where the hub comprises at least an outer cylindrical wall onto which the adhesive tape has been spirally wound, and where the adhesive tape is at least as wide as the hub. The tape dispenser comprises a first side member, a second side member, and a cutter member.

Each of the first and second side members has a first major side portion which overlies a roll of adhesive tape when the roll of adhesive tape is disposed within the tape dispenser. There is also a second minor side portion of each of the first and second side members, at an end thereof which is remote from the first major side portion.

The cutter member is mounted between the second minor side portions of the first and second side members.

Each of the first and second side members has a respective first and second cylindrical axle portion formed centrally on the inside surface of the first major side portion thereof. The outer diameter of a first one of the first and second cylindrical axle portions is less than the inner diameter of the second one of the first and second cylindrical axle portions, so that the first one of the cylindrical axle portions is telescopically received in the second one of the cylindrical axle portions. The telescopically joined first and second axle portions have a common cylindrical axis.

The outer diameter of the second one of the cylindrical axle portions is less that the diameter of a tape hub, so that the tape hub is slidably and rotatably received on the outer diameter of the second one of the cylindrical axle portions.

At least the first major side portion of at least one of the first and second side members is formed of a flexible plastics material. Thus, when the flexible first major side portion is pressed in a direction parallel to the common cylindrical axis of the telescopically joined first and second axle portions, the first one of the cylindrical axle portions extends further into the second one of the cylindrical axle portions until there is interference between the sides of the tape hub together with the adhesive tape spirally wound thereon, and at least portions of the inner surfaces of the first major side portions of the first and second side members.

A braking effect is thereby electively imposed on the rolled adhesive tape.

Typically, the first side member and the first cylindrical axle portion are integrally formed of a flexible plastics material. Also, the second side member, the second cylindrical portion, and the cutter member, are integrally formed of a rigid plastics material.

The first cylindrical axle portion generally has an outer end remote from the first side member, and a pair of wing-like projections formed at diametrically opposed sides thereof. Thus, the pair of wing-like projections extends radially outwardly from the first cylindrical axle portion at a location remote from the outer end thereof. Also, the second cylindrical axle portion has an inner end at the second side member, and it has a pair of notches formed at diametrically opposed sides thereof so as to receive a respective one of the pair of wing-like projections of the first cylindrical axle portion.

The width and length of each of the notches is sufficient to receive the wing-like projections therein, when the first and second side members of the tape dispenser are assembled together.

Accordingly, the wing-like projections interfere with the ends of the notches so as to preclude disassembly of the first and second side members one from the other; and also, the wing-like projections move in the notches in a direction towards the second side member when the flexible first side member is flexed.

Another provision of the present invention is that, when the tape dispenser is provided in combination with a roll of adhesive tape, quite typically the tape is wound on a hub which comprises a inner cylindrical wall, an outer cylindrical wall, and a centrally located radially extending wall between the inner and outer cylindrical walls. Thus, the hub has a wide "I" cross-section and an annular void which is formed between the inner and outer cylindrical walls at each side of the radially extending wall.

In some cases, the first major side portion of at least the first side member is formed of a flexible plastics material, and the remainder of at least the first side member is formed of a more rigid plastics material. In that case, the flexible plastics material is secured to the more rigid plastics material at the periphery of the first major side portion.

Typically, the first and second side members of any tape dispenser in keeping with the present invention, are moulded. Typically, that means that they are injection moulded.

The first cylindrical axle portion of the tape dispenser may be moulded so as to be flexible. Thus, when the outer end is squeezed in a manner so that the wing-like projections move diametrically towards each other and are disassociated from the notches of the second cylindrical axle portion, the tape dispenser may be disassembled so as to replace a hub from which adhesive tape has been unreeled with another hub having adhesive tape spirally wound thereon.

More typically, slits are formed axially along the first cylindrical axle portion along each side of each of the wing-like projections. The slits extend from the outer end of the first cylindrical axle portion towards the first major side portion of the first side member, to a length beyond the wing-like projections. Therefore, when the outer end of the first cylindrical axle portion is squeezed in a manner so that the wing-like projections move diametrically towards each other and are disassociated from the notches of the second cylindrical axle portion, the tape dispenser may be disassembled so as to replace a hub from which adhesive tape has been unreeled with another hub having adhesive tape spirally wound thereon.

Each of the second minor side portions of the first and second side members may be flared upwardly and outwardly. Thus, the cutter member may be wider than the adhesive tape which is wound spirally on a hub, when in place in the tape dispenser.

Typically, and in any event, the cutter member has a serrated outer cutting edge. That serrated cutting edge is placed high in the region of the flared second minor side portions. The flare of the second minor side portions may be such that the width of the cutting edge exceeds the width of the adhesive tape by at least 25%.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
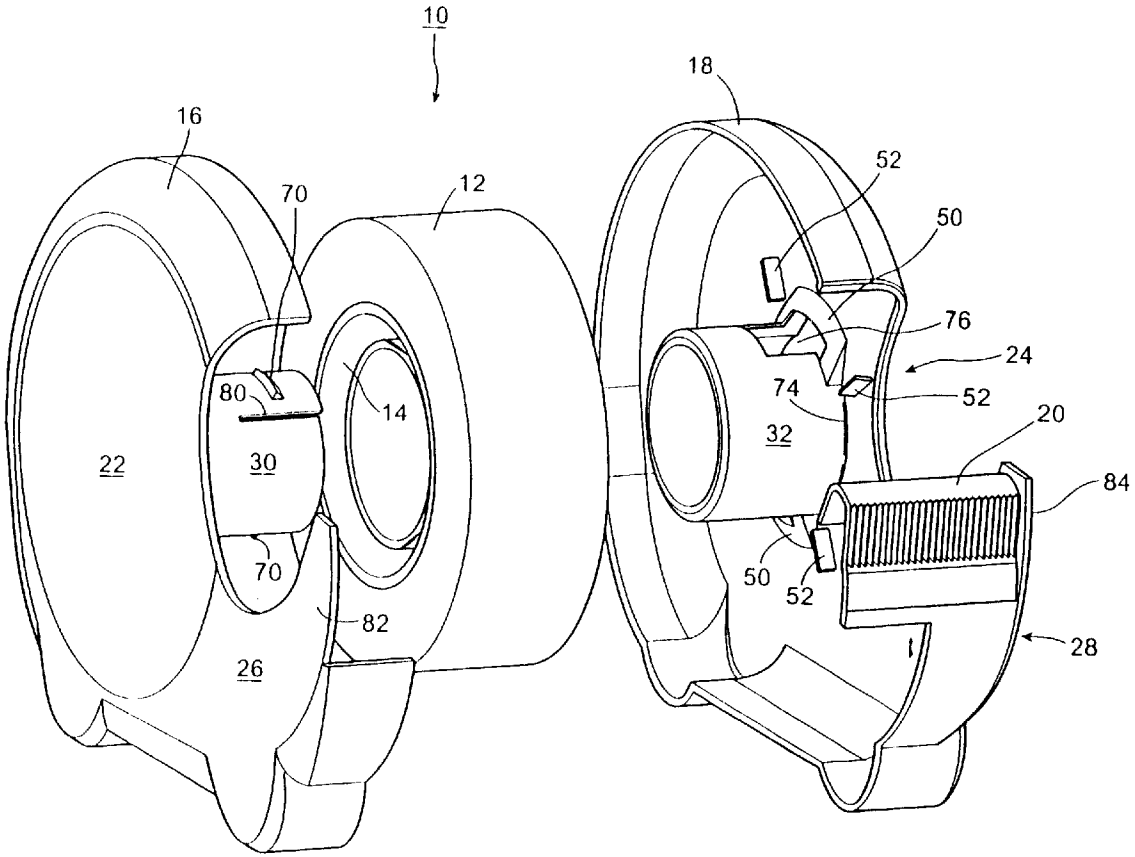
FIG. 1 is an exploded view of a typical embodiment of a tape dispenser in keeping with the present invention.
Figure 2:
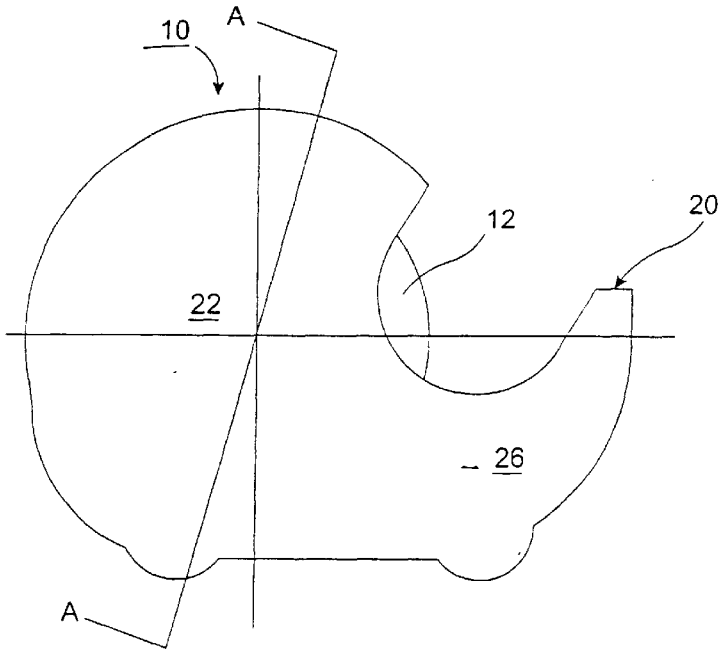
FIG. 2 is a side elevation of a tape dispenser in keeping with the present invention.

Turning first of FIG. 1, a tape dispenser 10 in keeping with the present invention is shown in a disassembled or exploded view. A roll of adhesive tape 12 will be placed into the tape dispenser 10, for dispensing therefrom. The roll of adhesive tape is mounted on a hub which is shown generally at 14; it will be understood that the hub 14 comprises at least an outer cylindrical wall onto which the adhesive tape has been spirally wound. Further details of a typical hub are described hereafter. Also, it will be understood that the adhesive tape is at least as wide as the hub 14.

The tape dispenser comprises a first side member 16, a second side member 18, and a cutter member 20.

Each of the first and second side members 16 and 18 has a first major side portion 22 and 24, respectively, which overlies a roll of adhesive tape 12 within the tape dispenser 10. There is also a second minor side portion 26 and 28, respectively of each of the first and second side members 16 and 18, at an end thereof which is remote from the respective first major side portions 22 and 24.

As can be seen in FIG. 1, the cutter member 20 is mounted between the second minor side portions 26 and 28 of the first and second side member 16 and 18.

Each of the first and second side members 16 and 18 has a respective cylindrical axle portion formed centrally on the inside surface of the first major side portion 22 or 24 thereof. Thus, there is a first cylindrical axle portion 30 which is formed centrally on the inside surface of the first major side portion 22 of the first side member 16; and there is a second cylindrical axle portion 32 which is formed centrally on the inside surface of the first major side portion 24 of the second side member 18.

It will be understood that the outer diameter of one of the first and second cylindrical axle portions is less than the inner diameter of the second one of the first and second cylindrical axle portions, so that one cylindrical axle portion may be telescopically received within the second cylindrical axle portion.

In this case, the outer diameter of the cylindrical axle portion 30 is less than the inner diameter of the second cylindrical axle portion 32. Thus, as can be determined from an inspection of FIGS. 3 to 6, the first cylindrical axle portion 30 is telescopically received in the second cylindrical axle portion 32.

Also, the first and second cylindrical axle portions 30, 32 will be understood to have a common cylindrical axis 38.

Clearly, the outer diameter of the second cylindrical axle portion 32 is less that the inner diameter of the tape hub shown generally at 14, so that the tape hub can be slidably and rotatably received on the second, outer, cylindrical axle portion 32.

As will be described in greater detail hereafter, at least the first side major portion (22 or 24) of at least one of the first and second side members (16 or 18) is formed of a flexible plastics material. Thus, when the flexible first major side portion is pressed in a direction which is parallel to the common cylindrical axis 38 of the telescopically joined first and second axle portions 30, 32, the first cylindrical axle portion 30 extends further into the second cylindrical axle portion 32 until there is an interference between the sides of the tape hub 14 together with the adhesive tape 12 spirally wound thereon, and at least portions of the inner surfaces of the first major side portions 22, 24 of the first and second side members 16, 18. This effect is clearly shown by inspection of FIGS. 4 and 6, in particular, and as described hereafter.

Figure 3:
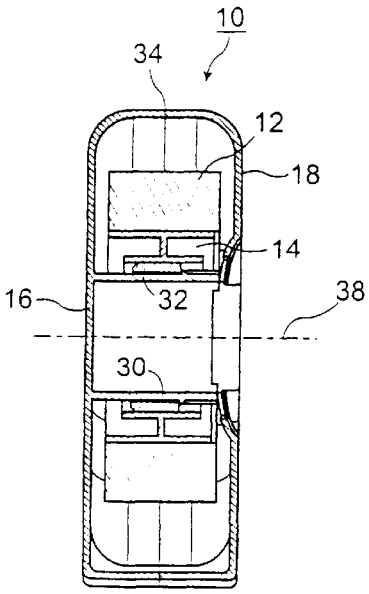
FIG. 3 is a cross-section, taken in the direction of arrows A—A in FIG. 2, when the sides of the tape dispenser are in an unstressed condition.
Figure 4:
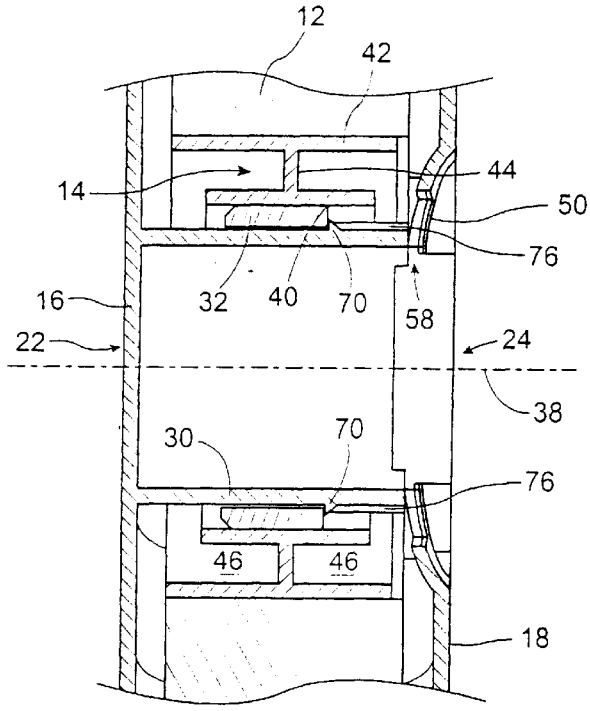
FIG. 4 shows details of FIG. 3, to a larger scale.
Figure 5:
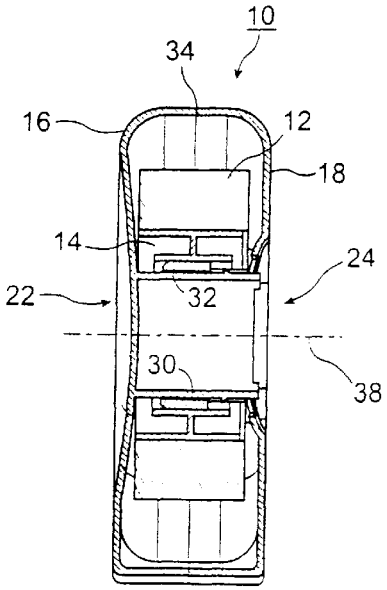
FIG. 5 is similar to FIG. 3, but with one side of the tape dispenser being shown in a flexed condition.

Turning to FIGS. 3 to 6, and referring first to FIGS. 3 and 4, further details of the assembly of the tape dispenser 10 in keeping with the present invention will be understood. It is seen that the first and second side members 16 and 18 are assembled together, so that they meet along line 34 except in the upper region of the respective second minor side portions 26 and 28. Typically, as seen in FIG. 1, the cutter member 20 and its associated structure is integrally formed together with the second side 18, which is typically formed of a more rigid plastics material that the material of the first side member 16.

Typically as can be seen in any FIGS. 3 to 6, the hub 14 on which the adhesive tape 12 has been spirally wound, comprises an inner cylindrical wall 40, and outer cylindrical wall 42, and a centrally located radially extending wall 44 which is placed between the inner and outer cylindrical walls 40 and 42. Thus, it is seen that the hub 14 will generally have a wide "I" cross-section, with an annular void 46 which is formed between the inner and outer cylindrical walls 40 and 42 at each side of the radially extending wall 44. It will be appreciated from FIG. 1, in particular, that the first side member 16 and the first cylindrical axle portion 30 may be integrally formed together of a flexible plastics material. Moreover, the second side member 18, the second cylindrical axle portion 32, and the cutter member 20, are also integrally formed together, usually of a more rigid plastics material.

However, it will also be understood that at least the first major side portion 22 of at least the first side member 16 may be formed of a flexible plastics material, with the remainder of the first side member 16 being formed of a more rigid plastics material. In that case, the flexible plastics material of the first major side portions 22 is secured to the more rigid plastics material of the remainder of the side member 16, at the periphery of the first major side portion 22.

Thus far, it will be understood that pressing against the at least one flexible major side portion 22 of the first side member 16 will thereby cause the first cylindrical axle portion 30 to move telescopically within the second cylindrical axle portion 32. As seen in FIGS. 3 to 6, that means that the first cylindrical axle portion 30 moves to the right, so as to move further within the second cylindrical axle portion 32. Comparison of FIGS. 3 and 4 with FIGS. 5 and 6, respectively, clearly shows that action. It will also be seen by comparison of FIGS. 3 and 4 with FIGS. 5 and 6 that an interferance between the sides of the tape hub 14 and the adhesive tape 12 which is spirally wound thereon, and at least portions of the inner surfaces of the first major side portions 22 and 24, occurs.

Figure 6:
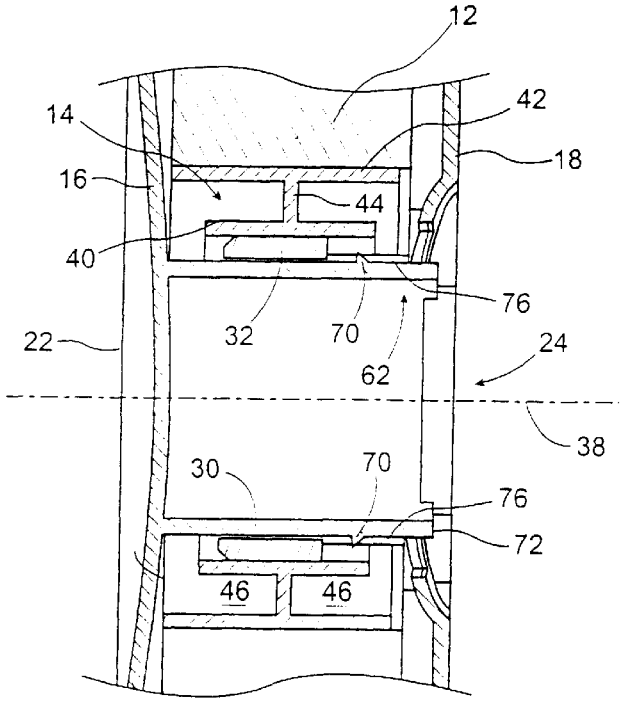
FIG. 6 is similar to FIG. 4, but showing details of FIG. 5.

There is a portion 50 which is formed on the inner surface of the second side member 18, and there may be a plurality of spokes 52 which are also upstanding from the inner surface of the first major side portion 24 of the second side member 18, as seen particularly in FIG. 1. Also, it is seen that there is a clearance 56 between the hub 14 and the adhesive tape 12, relative to the first side member 16. This is seen in FIG. 4. There may also be a clearance 58 at the side of the hub 14 relative to the upset portion 50 of the second side member 18. Nonetheless, as will be seen particularly by a comparison of FIGS. 4 and 6, the clearance 56 disappears when the first major side portion 22 of the side member 16 is flexed inwardly along axis 38, as shown in FIG. 6, so that interference as shown at 60 in FIG. 6 occurs between the hub 14 and/or the tape 12; and interference at 62 between the hub 14 and at least the upset portion 50 of the second side member 18 is assured. It is that interference 62 which determines the extent at which the flexible first major side portion 22 of the side member 16 may be flexed.

Obviously, when the interference occurs as at 60 and 62, a braking effect on the hub 14 and or adhesive tape 12 is achieved, thereby precluding further unreeling of the adhesive tape 12 from the hub 14. Accordingly, a specific length of tape can be dispensed, without concern of there being overrun as the adhesive tape is unreeled from the hub. This, in turn, assures a clean cut of the tape at the cutter member 20, as it is drawn down and across the cutter member 20 in well known fashion.

It will be seen particularly in FIGS. 1 and 3 to 6, that there is a pair of wing-like projections 70 which are formed near the outer end 72 of the first cylindrical axle portion 30. Obviously, the end 72 is remote from the first side member 16, or at least the first major side portion 22 thereof.

In any event, the pair of wing-like projections 70 is formed at diametrically opposed sides of the first cylindrical axle portion 30, so as to extend radially outwardly therefrom. As noted, the location of the pair of wing-like projections 70 is remote from the outer end 72 of the first cylindrical axle portion 30.

Moreover, the second cylindrical axle portion 32 has an inner end 74 where it extends from the second side number 18, and there is a pair of notches 76 which is formed in the second cylindrical axle portion 32 at diametrically opposed sides thereof. As seen particularly in FIGS. 3 to 6, the width and length of the pair of notches 76 are such as to receive a respective one of the pair of wing-like projections 70.

The length of each of the pairs of notches 76 is sufficient to receive the wing-like projections 70 therein, when the first and second side members are assembled together, as seen particularly in FIGS. 3 and 4. Typically, the wing-like projections 70 interfere with the ends of the notches 76, and thus they preclude disassembly of the first and second side members 16 and 18 one from the other. Also, as is seen by comparison of FIGS. 3 and 4 with FIGS. 5 and 6, respectively, the wing-like projections 70 move within the notches 76 in a direction towards the second side member 18 when the flexible first side member 16—at least the flexible first major side portion 22 thereof—is flexed and moved in a direction towards the second side number 18.

Moreover, the material of the first cylindrical axle portion 30 may be flexible, so that when the outer end 72 thereof is squeezed in a manner so that the wing-like projections 70 move diametrically towards each other and are disassociated from the notches 76 formed in the second cylindrical axle portion 32, then the tape dispenser 10 may be disassembled so as to replace a hub 14 from which adhesive tape 12 has been unreeled with another hub 14 on which adhesive tape 12 has been spirally wound. Therefore, the tape dispenser of the present invention is reusable with additional rolls of adhesive tape.

However, more commonly, slits 80 are formed axially along the first cylindrical axle portion 30 at each side of each of the wing-like projections 70. The slits extend from the outer end 72 of the first cylindrical axle portion 30 towards the first major side portion 22 of the first side member 16, to a length beyond the wing-like projections 70. Thus, when the outer end 72 of the first cylindrical axle portion 30 is squeezed in such a manner that the wing-like projections 70 move diametrically towards each other and are disassociated from the notches 76 of the second cylindrical axle portion 32, than the tape dispenser 10 may be disassembled in the same manner as discussed above.

Referring briefly to the cutter member 20, it is noted that in general the cutter member 20 is formed integrally with the second side member 18. Also, each of the second minor portions 26 and 28 of the respective first and second side members 16 and 18 may be flared upwardly and outwardly as indicated at 82 and 84 in FIG. 1. Thus, the cutter member 20 is wider than the adhesive tape 12. This assists in placing the adhesive tape 12 across the cutter member 20 when a length of the adhesive tape is to be dispensed; and especially because of the braking action of the tape dispenser of the present invention against the roll of adhesive tape 12, an accurate cut of a specific length of adhesive tape 12 may be made.

As seen in FIG. 1, the cutter member 20 has a serrated outer cutting edge which is placed high in the region of the flared second minor side portions 82 and 84. Such serrated outer cutting edges are known: it will be noted that the serrated outer cutting edge of the cutting member 20 is formed integrally therewith, and is not an additional metal cutter that is added to the tape dispenser 10.

Typically, the width of the edge of the cutting member 20 exceeds the width of the adhesive tape 12 by at least 25%.

There has been described a tape dispenser which functions particularly to preclude unwanted unreeling of the adhesive tape from a roll thereof particularly as the adhesive tape is to be cut. Several alternative embodiments of the tape dispenser are suggested, including particularly where the first major side portion 16 may be formed of a flexible material, or where the first major side portion 22 of the first side member 16 is formed of a flexible plastics material. Of course, either side member 16 or 18, or both side members 16 and 18, may be formed of flexible material.

Throughout this specification and the claims which follow, unless the context requires otherwise, the word "comprises" or "comprising", will be understood to imply the inclusion of a stated integer or step of integers or steps of integers but not to the exclusion of any other integer or step or group of integer steps.

Other modifications and alterations may be used in the design and manufacture of the apparatus of the present invention without departing from the spirit and scope of the accompanying claims.

What is claimed is:

1. A tape dispenser for dispensing rolled adhesive tape mounted on a hub, where the hub comprises at least an outer cylindrical wall onto which the adhesive tape is spirally wound, and where the adhesive tape is at least as wide as the hub; said tape dispenser comprising:

a first side member, a second side member, and a cutter member;

wherein each of said first and second side members has a first major side portion which overlies a roll of adhesive tape within said tape dispenser, and a second minor side portion at an end thereof remote from said first major side portion;

wherein said cutter member is mounted between said second minor side portions of said first and second side members;

each of said first and second side members having a respective first and second cylindrical axle portion formed centrally on the inside surface of the first major side portion thereof, wherein the outer diameter of a first one of said first and second cylindrical axle portions is less than the inner diameter of the second one of said first and second cylindrical axle portions, so that said first one of said cylindrical axle portions is telescopically received in said second one of said cylindrical axle portions, and said telescopically joined first and second cylindrical axle portions have a common cylindrical axis;

wherein the outer diameter of said second one of said cylindrical axle portions is less than the inner diameter of said tape hub, so that said tape hub is slidably and rotatably received thereon; and wherein at least said first major side portion of at least one of said first and second side members is formed of a flexible plastics material so that, when said flexible first major side portion is pressed using finger pressure in a direction parallel to said common cylindrical axis of said telescopically joined first and second axle portions, said first one of said cylindrical axle portions extends further into said second one of said cylindrical axle portions until there is interference between the sides of said tape hub together with the adhesive tape spirally wound thereon, and at least portions of the inner surfaces of the first major side portions of said first and second side members.

2. The tape dispenser of claim 1, wherein said first side member and said first cylindrical axle portion are integrally formed of a flexible plastics material; and wherein said second side member, said second cylindrical axle portion, and said cutter member, are integrally formed of a rigid plastic material.

3. The tape dispenser of claim 1, wherein said first cylindrical axle portion has an outer end remote from said first side member, and a pair of wing-shaped projections formed at diametrically opposed sides thereof so as to extend radially outwardly therefrom at a location remote from said outer end thereof; and said second cylindrical axle portion has an inner end at said second side member, and has a pair of notches formed at diametrically opposed sides thereof so as to receive a respective one of said pair of wing-shaped projections of said first cylindrical axle portion;

wherein the width and length of each of said notches is adapted to receive said wing-shaped projections therein when said first and second side members are assembled together;

whereby said wing-shaped projections interfere with the ends of said notches to preclude disassembly of said first and second side members one from the other, and said wing-shaped projections move in said notches in a direction towards said second side member when said flexible first major side portion is flexed.

4. The tape dispenser of claim 1, in combination with a roll of adhesive tape, where the tape is wound on a hub which comprises an inner cylindrical wall, an outer cylindrical wall, and a centrally located radially extending wall between said inner and outer cylindrical walls, so as to have wide "I" cross-section, and an annular void is formed between said inner and outer cylindrical walls at each side of said radially extending wall.

5. The tape dispenser of claim 1, wherein said first major side portion of at least said first side member is formed of flexible plastic material, and the remainder of said at least said first side member is formed of a more rigid plastic material;

wherein said flexible plastic material is secured to said more rigid plastic material at the periphery of said first major side portion.

6. The tape dispenser of claim 2, wherein said first and second side members are molded.

7. The tape dispenser of claim 3, wherein said first cylindrical axle portion is flexible, so that when said outer end is squeezed in a manner so that said wing-shaped projections move diametrically towards each other and are disassociated from said notches of said second cylindrical axle portion, said tape dispenser may be disassembled so as to replace a hub from which adhesive tape has been unreeled with another hub having adhesive tape spirally wound thereon.

8. The tape dispenser of claim 3, wherein slits are formed axially along said first cylindrical axle portion at each side of each said wing-shaped projection, and wherein said slits extend from said outer end of said first cylindrical axle portion towards said first major side portion of said first side member to a length beyond said wing-shaped projection, so that when said outer end is squeezed in a manner so that said wing-shaped projection move diametrically towards each other and are disassociated from said notches of said second cylindrical axle portion. said tape dispenser may be disassembled so as to replace a hub from which adhesive tape has been unreeled with another hub having adhesive tape spirally wound thereon.

9. The tape dispenser of claim 1, in combination with a roll of an adhesive tape wherein each of said second minor side portions of said first and second side members is flared upwardly and outwardly, whereby said cutter member is wider than the adhesive tape wound spirally on a hub, when in place in said tape dispenser.

10. The combination of claim 9, wherein said cutter member has a serrated outer cutting edge which is placed high in the region of said flared second minor side portions, and wherein the width of said cutting edge exceeds the width of said adhesive tape by at least 25%.

* * * * *